United States Patent [19]

Emsley

[11] 4,013,525

[45] Mar. 22, 1977

[54] ELECTROLYTIC CELLS

[75] Inventor: Alan Brian Emsley, Runcorn, England

[73] Assignee: Imperial Chemical Industries Limited, London, England

[22] Filed: Sept. 19, 1974

[21] Appl. No.: 507,603

[30] Foreign Application Priority Data

Sept. 24, 1973 United Kingdom ..... 44682/73
July 4, 1974 United Kingdom ..... 29683/74

[52] U.S. Cl. ..... 204/98; 204/128; 204/266; 204/283; 204/284; 204/286; 204/290 F

[51] Int. Cl.[2] ..... C25C 1/26; C25C 11/02; C25C 11/03

[58] Field of Search ..... 204/98, 128, 254, 255, 204/256, 283, 284, 286, 290 F, 263, 266, 269, 275, 289, 2

[56] References Cited

UNITED STATES PATENTS

| | | | |
|---|---|---|---|
| 1,269,566 | 6/1918 | MacDougall et al. | 204/256 X |
| 1,548,840 | 8/1925 | Holmboe | 204/289 |
| 1,588,579 | 6/1926 | Holmboe | 204/289 |
| 3,507,771 | 4/1970 | Donges et al. | 204/284 |
| 3,676,325 | 7/1972 | Smith et al. | 204/284 X |
| 3,803,016 | 4/1974 | Conner, Jr. | 204/266 X |
| 3,873,437 | 3/1975 | Pulver | 204/284 X |

FOREIGN PATENTS OR APPLICATIONS

| | | |
|---|---|---|
| 1,251,050 | 12/1960 | France |
| 65,931 | 5/1972 | South Africa |
| 1,267,985 | 3/1972 | United Kingdom |
| 1,313,298 | 4/1973 | United Kingdom |
| 1,321,109 | 6/1973 | United Kingdom |
| 1,324,427 | 7/1973 | United Kingdom |
| 1,336,225 | 11/1973 | United Kingdom |
| 1,394,026 | 5/1975 | United Kingdom |

*Primary Examiner*—Arthur C. Prescott
*Attorney, Agent, or Firm*—Cushman, Darby & Cushman

[57] ABSTRACT

An electrolytic cell, for example for the manufacture of chlorine from sodium chloride brine, comprising an anode, a cathode and a diaphragm separating the anode and the cathode wherein the anode presents to the cathode a plurality of parallel elongated members carrying on at least part of their surfaces an electrocatalytically active coating and wherein said elongated members are rigidly mounted in the cell so that a substantial portion of said active surfaces is six millimeters or less from the cathode. The elongated members are preferably in the form of blades, rods or channel shaped members, which may be mounted on, for example, backing plates, backing frames or multiapertured sheets. The elongated members and support means are preferably of titanium and the coating is preferably a mixture of ruthenium oxide and titanium oxide.

30 Claims, 13 Drawing Figures

ELECTROLYTIC CELLS

This invention relates to improvements in electrolytic cells.

More particularly, it relates to electrolytic cells having anodes made of a film-forming metal and which carry an electrocatalytically active coating. It also relates to diaphragm cells containing such anodes and more particularly to diaphragm cells for the electrolysis of aqueous solutions of alkali-metal halides.

A wide variety of diaphragm cells are known which consist in principle of a series of anodes and a series of cathodes disposed in a parallel alternating manner and separated from each other by a substantially vertical diaphragm. In cells of recent design, the anodes are suitably in the form of plates of a film-forming metal (usually titanium) and carry an electrocatalytically active coating (for example a platinum metal oxide); the cathodes are suitably in the form of a perforated plate or tube of metal (usually mild steel); and the diaphragms, which are usually deposited on or fitted to the surface of the cathodes, are suitably made of asbestos or a synthetic organic polymeric material, for example polytetrafluoroethylene or polyvinylidene fluoride.

In operating a diaphragm cell, it is advantageous to operate with as small a distance as possible between the anode and the cathode (the anode/cathode gap) in order to keep the ohmic losses (and hence the cell voltage) to a minimum. At the same time it is desirable to operate at an economic current density, for example 2 kA/m$^2$.

The use of high current densities and small anode/cathode gaps, however, results in a high rate of evolution of gas (for example chlorine) during electrolysis which can in turn cause a foam of gas and electrolyte. This foam can partially fill the anode/cathode gap in the anolyte compartment, thus driving the electrolyte out of the cell and at least in part preventing further electrolysis. This problem has been mitigated by breaking the foam outside the cell so as to separate the gas and the electrolyte by recycling the electrolyte through the anolyte compartment, for example as described in the specification of our UK Pat. No. 1,123,321. The problem may be further mitigated by use of a perforated or expanded metal anode. With existing commercial cells however, it is not possible to operate with anode/cathode gaps of less than 7 mm and this is a considerable disadvantage from the point of view of the efficiency of the cell.

Although these methods referred to above have enabled diaphragm cells to operate at high current densities and with smaller anode/cathode gaps, a high current efficiency is achieved only at relatively low cell conversions. When electrolysing an aqueous solution of sodium chloride, for example, to give chlorine and sodium hydroxide solution, a current efficiency of 95 to 96% is achieved at a salt conversion of about 50%. At higher conversions, the current efficiency is reduced; for example, it falls to about 92 at 60% conversion and to about 84 at 70% conversion.

We have now designed a diaphragm cell which operates at a lower effective anode/cathode gap than was hitherto possible while still enabling the chlorine to be removed in a controlled and regular manner, and which can be operated at low voltages and at high current efficiencies, particularly at high salt conversions.

According to the present invention we provide an electrolytic cell comprising an anode, a cathode and a diaphragm separating the anode and the cathode wherein the anode presents to the cathode a plurality of parallel elongated members carrying on at least part of their surfaces an electrocatalytically active coating and wherein said elongated members are rigidly mounted in the cell so that a substantial portion of said active surfaces is 6 millimeters or less from the cathode.

The elongated members are preferably mounted on support means forming part of the anode and preferably present their narrower edge to the cathode. The elongated members may be in the form of blades, rods or channel members of U-shape, inverted U-shape or hemicylindrical shape. It is preferred to use blades, for example single blades, but the blades may also be in the form of double blades which are spaced-apart from and connected to one another by one or more bridge portions suitable for strengthening purposes and/or for connecting to said support means.

The gap between adjacent elongated members is substantially constant. This may be achieved, for example, by using a plurality of double blades in which the blades are spaced apart by a distance equal to the desired blade gap. The blade gap may for example, be in the range from 1.5 to 10 mm but is preferably in the range from 2 to 5 mm.

A wide variety of support means may be used. The support means may comprise a backing plate, for example a substantially solid metal sheet provided with apertures for recycling of anolyte. In another arrangement, the support means may comprise a backing frame, preferably a backing frame provided with one or more lateral support ribs for connection to elongated members. The backing frame is conveniently rectangular in shape having two opposing inner edges spaced apart at a distance which is approximately equal to the total width of the elongated members, and having the other two inner edges spaced apart at a distance which is slightly shorter than the length of the said members to allow for connection of the ends of the members to to the frame.

Alternatively, the elongated members may be provided with a lateral support bar member connected to the ends of said members, and wherein said bar is for connection to the baseplate of the cell. The elongated members may also be provided with a further lateral support bar connected to the ends of the said members remote from the first lateral support bar.

In yet another arrangement, the support means may comprise a multi-apertured metal backing sheet, for example woven gauze, drilled plate or expanded metal.

The elongated members and support means may be held together in close contact with an insulating gasket interposed therebetween. Alternatively, the elongated members may be attached to the support means by welding or the whole structure may be stamped out in one piece. For example, double bladed elongated members as hereinbefore described may be welded by means of their bridge portions to support means such as metal sheets, metal frames and their lateral ribs (if present), and lateral support bars located at one or both ends of the elongated members.

It will be understood that the combination of elongated members with support means comprising a backing frame, a lateral support bar for connection to the cell base, or a multiapertured backing sheet provides a substantially open structure for the anode, that is, a plurality of open passages from front to back are provided which are defined by the spaces between adjacent elongated members. When the anode is in use in a diaphragm electrolytic cell, it provides a plurality of passages between the active surface of the anode (in close proximity to the diaphragm) and the space behind the anode, thereby allowing anolyte liquor to pass through the anode.

The elongated members and support means are preferably of a film-forming metal. In this specification, by "a film-forming metal" we mean one of the metals titanium, zirconium, niobium, tantalum or tungsten or an alloy consisting principally of one of these metals and having anodic polarisation properties which are comparable to those of the pure metal. It is preferred to use titanium alone or an alloy based on titanium and having polarisation properties comparable to those of titanium. Examples of such alloys are titanium-zirconium alloys containing up to 14% of zirconium, alloys of titanium with up to 5% of a platinum group metal such as platinum, rhodium or iridium and alloys of titanium with niobium or tantalum containing up to 10% of the alloying constituent.

The electrocatalytically active coating is a conductive coating which is resistant to electrochemical attack but is active in transferring electrons between electrolyte and the anode.

The electrocatalytically active material may suitably consist of one or more platinum group metals, ie platinum, rhodium, iridium, ruthenium, osmium and palladium, and alloys of the said metals, and/or the oxides thereof, or another metal or a compound which will function as an anode and which is resistant to electrochemical dissolution in the cell, for instance rhenium, rhenium trioxide, magnetite, titanium nitride and the borides, phosphides and silicides of the platinum group metals. The coating comprising an operative electrode material may also contain electronically non-conducting oxides, particularly oxides of the film-forming metals such as titanium and/or of other metals, such as tin, as is known in the art, to anchor the operative electrode material more securely to the supporting film-forming metal structure and to increase the resistance of the operative electrode material to dissolution in the working cell.

Preferred coatings include platinum, platinum-/iridium alloys, platinum group metal oxides, particularly ruthenium oxide, and especially mixtures of platinum group metal oxides and film-forming metal oxides, for example ruthenium oxide and titanium dioxide. The platinum metal coatings may be formed, for example, by electro-deposition on the film-forming metal, for example as described in UK Pat. No. 1,237,077. Platinum group metals and their conducting compounds, particularly oxides, are readily produced by thermal decomposition techniques as described for example in UK Pat. Nos. 1,147,442; 1,195,871, 1,206,863 and 1,244,650.

The cathode may suitably be in the form of a perforated metal sheet or tube. However, the cathode may also comprise a plurality of parallel elongated members mounted on support means, for example a plurality of blades, rods or channel shaped members mounted on support means. An especially preferred cathode comprises a plurality of double blades (of the type hereinbefore described) mounted on support means, for example a backing frame. The elongated members and support means are preferably of mild steel.

The use of cathodes comprising a plurality of elongated members on a backing frame has the advantage of increasing the rate of extraction of fillers when preparing porous synthetic diaphragms (eg of polytetrafluoroethylene) by the electrolytic removal of filler in situ in the cell (as described in our copending U.S. Pat. application Ser. No. 484,935, filed on July 1, 1974, now abandoned).

The diaphragm cell according to the invention can be operated at an anode/cathode gap of 6 mm or less to give a low cell voltage. When electrolysing sodium chloride brine, for example, an effective anode/cathode gap of about 1.5 to 3 mm can be maintained as compared with about 7 mm when using a plain sheet anode. The cell voltage is in the region of 2.6 to 2.8 volts at 2 kA/m$^2$ at 80° to 85° C (normally 3.0 to 3.2 volts when using plain sheet anodes and polytetrafluoroethylene diaphragms). The anodes are preferably mounted substantially vertically, although they may be tilted slightly from the vertical position without unduly affecting current efficiency.

The diaphragm cell according to the invention, especially when using anodes comprising a plurality of blades of a film-forming metal, have the further advantage of prolonging the life of the diaphragm, especially when using porous synthetic diaphragms based on organic polymers such as polytetrafluoroethylene or polyvinylidene fluoride. Such diaphragms normally become severely blocked in a relatively short period, for example 10 to 20 days when electrolysing sodium chloride brine, owing to the precipitation of solids (for example calcium and magnesium hydroxides) in the pores of the diaphragm. Such precipitation is caused by the high alkalinity of the catholyte liquor and the presence of calcium and magnesium ions which are present even after purification of the brine before electrolysis. When using anodes comprising titanium blades the porous synthetic diaphragms showed no signs of a decrease in permeability even after 24 days.

It has been observed in the course of using anodes comprising titanium double blades on titanium sheets that the pH of the anolyte when electrolysing sodium chloride is less than normally obtained when using plain sheet anodes, for example in the region 3.2 to 3.5 instead of 3.8 to 4.5. The resultant reduction in pH is probably an important factor in respect of the improved life of the diaphragm.

A further advantage of the cell according to the invention is that the chlorate concentration of anolyte liquor is reduced at an increased caustic soda concentration as compared with the corresponding concentrations achieved when using conventional plate anodes. For example, the cell of the invention may be operated to give chlorate concentrations in the range of 0.03 to 0.50 g.p.l $ClO_3$ at caustic soda concentrations in the range 120 to 210 g.p.l NaOH respectively. By comparison, the corresponding ranges of concentration when using plate anodes are 0.50 to 10.0 g.p.l $ClO_3$ and 120 to 200 g.p.l NaOH.

The invention is applicable to both horizontal and vertical electrolytic diaphragm cells and is especially applicable to diaphragm cells used for the manufacture of chlorine by the electrolysis of aqueous alkali metal chloride solutions, especially sodium chloride solutions.

By way of example, embodiments of the present invention will now be described with reference to FIGS. 1 to 13 in which FIG. 1 is a perspective view of an anode comprising a plurality of double-bladed elongated members mounted on a backing plate.

Figure 1:
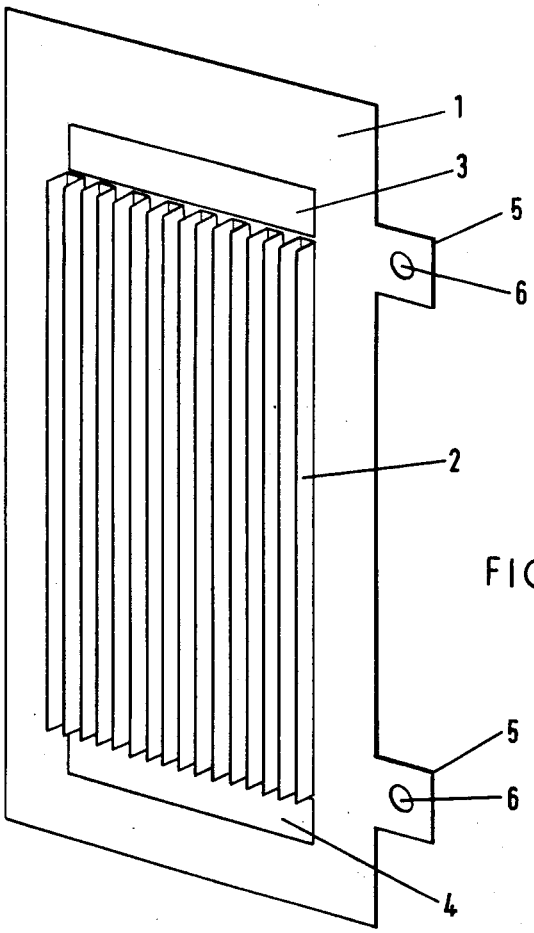

Referring to FIG. 1, the anode consists of a backing plate 1 made of a sheet of a film-forming metal, for example titanium, and a plurality of double blades 2 made of a film-forming metal, for example titanium, the said blades being spot-welded to the plate. The blades 2 are coated with an electrocatalytically active material, for example a ruthenium oxide/titanium dioxide coating. The anode is further provided with slots 3, 4 for internal recirculation of anolyte liquor (as described below) and is also provided with lugs 5 carrying holes 6, for connecting the anode to current lead-in means.

Figure 2:
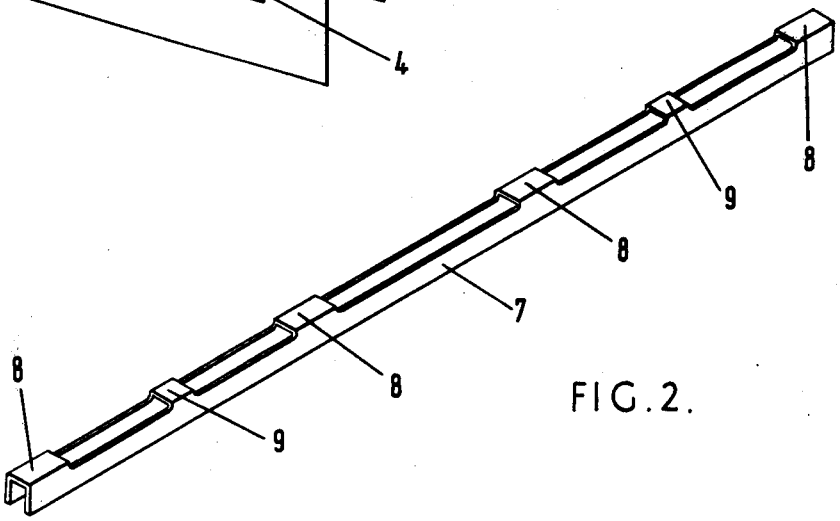
FIG. 2 is a perspective view of a double bladed elongated member suitable for use in fabricating the anodes of FIG. 1 or FIG. 5 or the cathode of FIG. 8.

Referring to FIG. 2, the double blade (constituting one of the plurality of such blades shown in FIG. 1) consists of a pair or single blades 7, bridge portions 8 to enable the double blade to be spot-welded to the plate 1, and bridge portions 9 for strengthening purposes.

Figure 3:
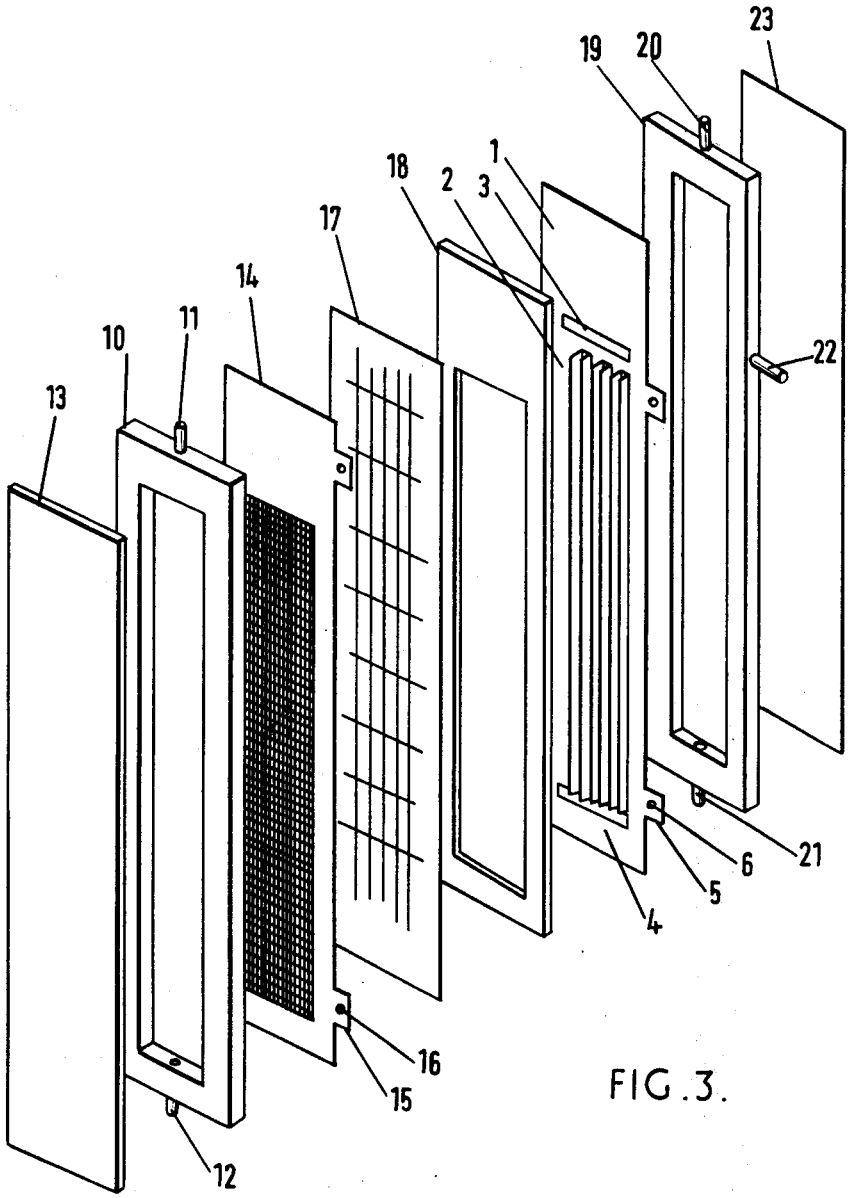
FIG. 3 is an exploded view of the constituent parts of a laboratory vertical diaphragm cell according to the invention for electrolysing sodium chloride brine and including an anode as shown in FIG. 1.

Referring to FIG. 3, a catholyte compartment 10, suitably of polyvinylidene chloride or polypropylene, having an outlet 11 for the removal of hydrogen and an outlet 12 for the removal of sodium hydroxide solution (cell liquor), is positioned between and adjacent to a backing plate 13 (suitably of mild steel) and a cathode 14 (suitably of mild steel woven mesh). The cathode 14 is provided with lugs 15 having holes 16 for connecting the cathode to a current lead-in means (not shown). The cathode 14 carries a diaphragm 17, for example a polytetrafluoroethylene diaphragm, and this is in turn separated from the anode 1 by means of a spacer plate 18 (suitably of polyvinylidene chloride). The spacer plate 18 determines the anode/cathode gap. The anolyte compartment 19, suitably of polyvinylidene chloride or polypropylene, having an outlet 20 for chlorine (in practice a foam of chlorine and anolyte liquor), a drainage outlet 21 for anolyte liquor, and an inlet 22 for recycled anolyte liquor (see later), is positioned between and adjacent to the back of the anode 1 and a backing plate 23 (suitably of titanium).

Figure 4:
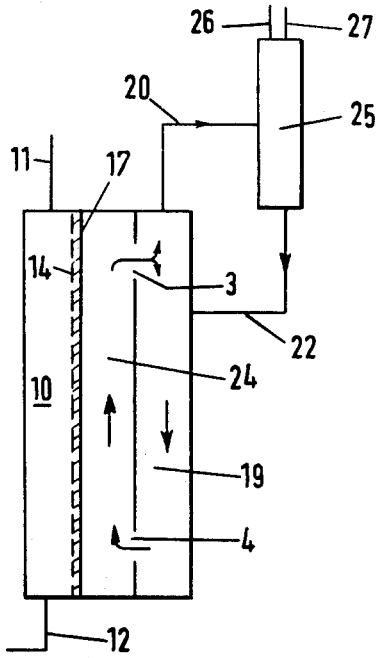
FIG. 4 is a schematic flow diagram of the aforesaid diaphragm cell showing the anolyte recirculation system.

Referring to FIG. 4, the aforesaid diaphragm cell is represented as comprising the catholyte compartment 10, the anolyte compartment 19 and the anode/cathode gap 24. The anolyte compartment 19 connects via outlet 20 to a liquid/gas separator 25 in which the foam of chlorine and anolyte liquor is separated into its constituent parts. The separator 25 is provided with an outlet 26 for chlorine, an inlet 27 for fresh feed brine, and an outlet 22 which connects with the anolyte compartment 19 to recycle the separated anolyte liquor. When the cell is operating, the anolyte liquor flows upwardly in the anode/cathode gap 24, passes through the slot 3 and then splits into two parts (as indicated by the arrows in FIG. 4), one part flowing directly into the anolyte compartment 19 and then inwardly through the slot 4 (internal recirculation) and the other part being circulated externally via the separator 25 and thence back to the anolyte compartment.

Figure 5:
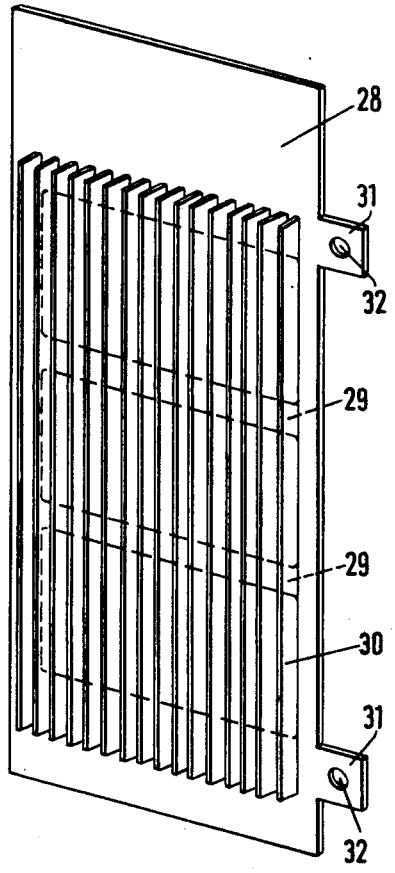
FIG. 5 is a perspective view of an anode comprising a plurality of double-bladed elongated members mounted on a backing frame.

Referring to FIG. 5, the anode consists of a rectangular metal backing frame 28, having lateral support ribs 29 (shown as dotted lines), and a plurality of double blades 30 (of the type shown in FIG. 2). The frame 28, ribs 29 and blades 30 are made of a film-forming metal, for example titanium, the said blades 30 being spot-welded to the frame 28 and ribs 29 by means of bridge portions. The blades 30 are coated with an electrocatalytically active material, for example a ruthenium oxide/titanium dioxide coating. The anode is provided with lugs 31 having holes 32, for connecting the anode to current lead-in means (not shown).

Figure 6:
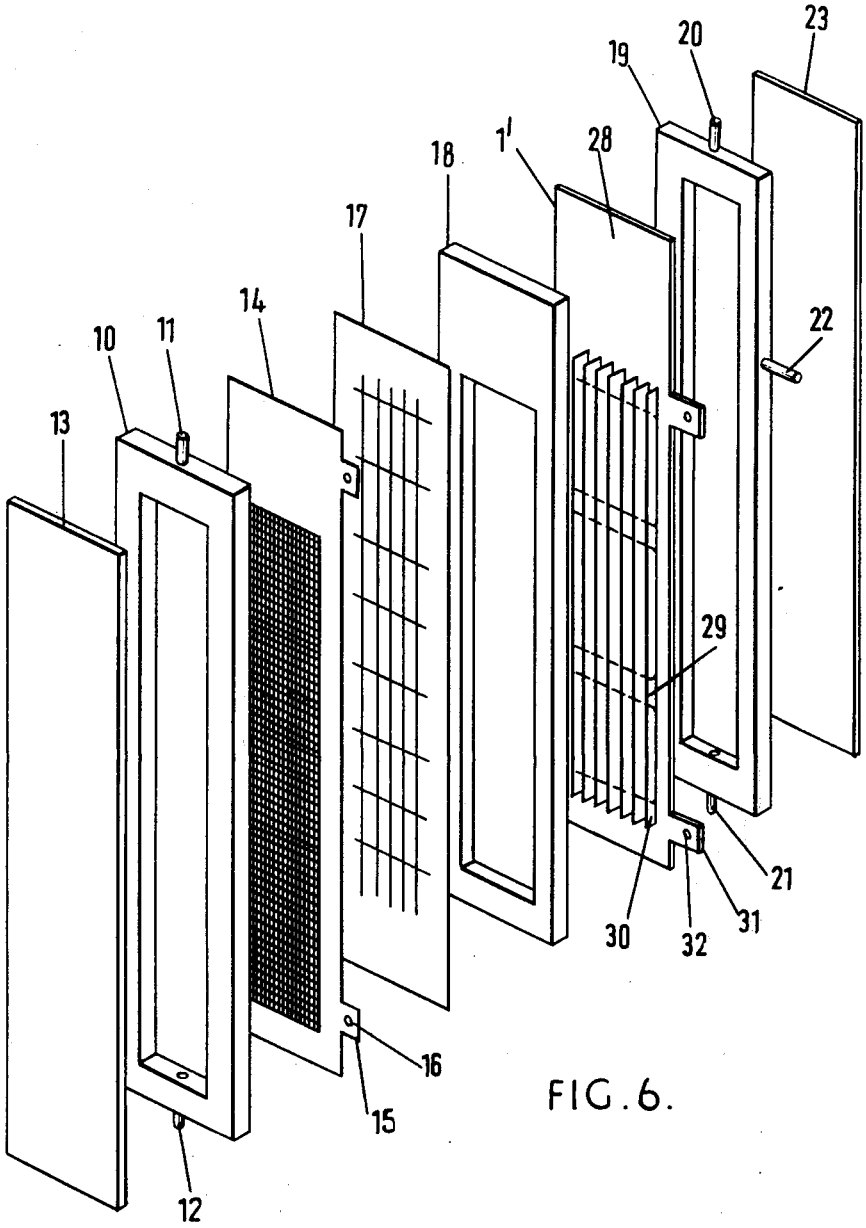
FIG. 6 is an exploded view of the constituent parts of a laboratory vertical diaphragm cell according to the invention for electrolysing sodium chloride brine and including an anode as shown in FIG. 5.

Referring to FIG. 6, the arrangement is as shown in FIG. 3 except that the anode 1 is replaced by anode 1′ as shown in FIG. 5.

Figure 7:
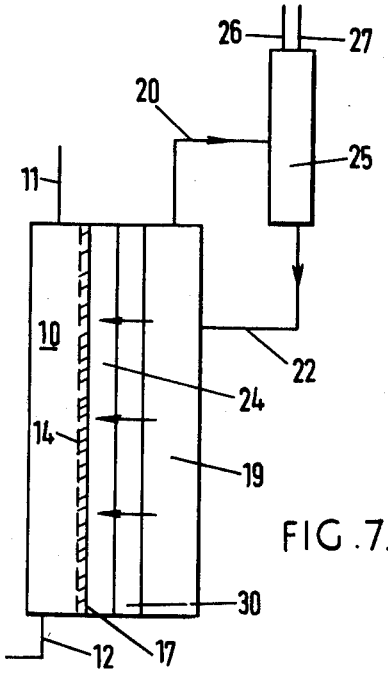
FIG. 7 is a schematic flow diagram of the diaphragm cell of FIG. 6 showing the anolyte recirculation system.

Referring to FIG. 7, it will be seen that when the cell is operating, the anolyte liquor flows across the anode/cathode gap 24 and passes through the blades 30 of the anode (as indicated by the arrows).

Figure 8:
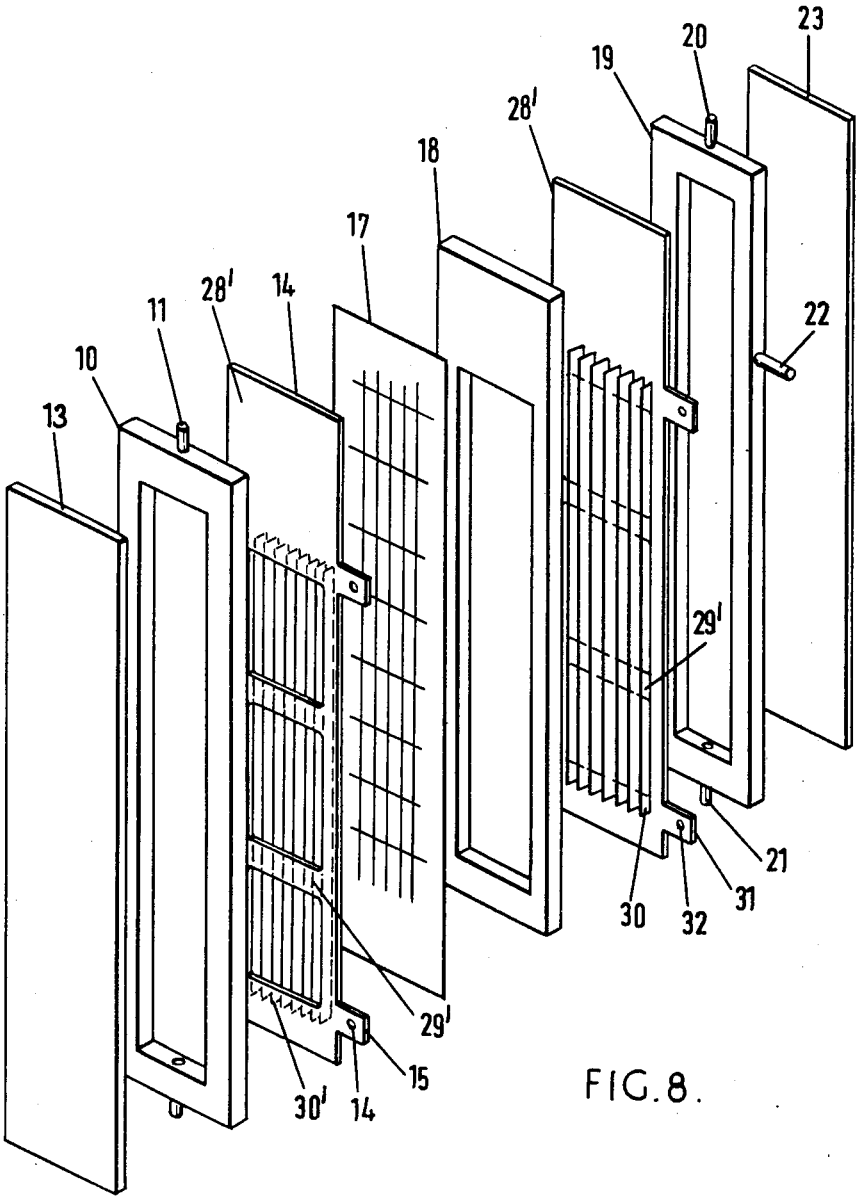
FIG. 8 is an exploded view of the constituent parts of a laboratory vertical diaphragm cell according to the invention for electrolysing sodium chloride brine and including an anode of FIG. 5 and a cathode which is similar in shape to the anode of FIG. 5.

Referring to FIG. 8, the cathode 14 consists of a rectangular metal backing frame 28′, having lateral support ribs 29′ and a plurality of double blades 30′. The frame 28′, ribs 29′ and blades 30′ are made of mild steel, the said blades 30′ being spot-welded to the frame 28′ and ribs 29′ by means of bridge portions. The cathode is provided with lugs 15, having holes 14, for connecting the anode to current lead-in means (not shown). The anode is as described in FIG. 5.

Figure 9:
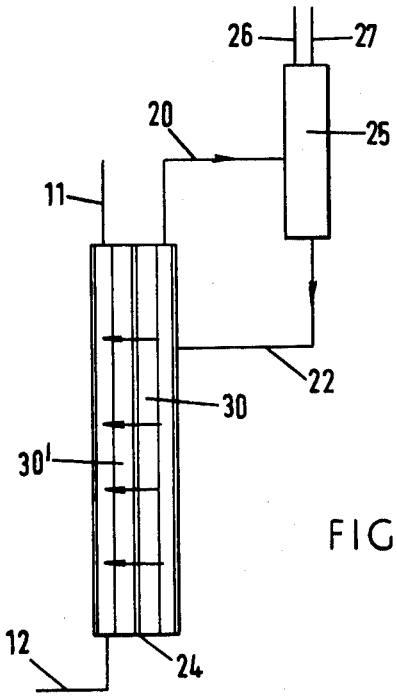
FIG. 9 is a schematic flow diagram of the diaphragm cell of FIG. 8 showing the anolyte recirculation system.

Referring to FIG. 9, it will be seen that when the cell is operating, the anolyte liquor flows across the anode/-cathode gap 24 and passes through the blades 30 of the anode and the blades 30' of the cathode (as indicated by the arrows).

Figure 10:
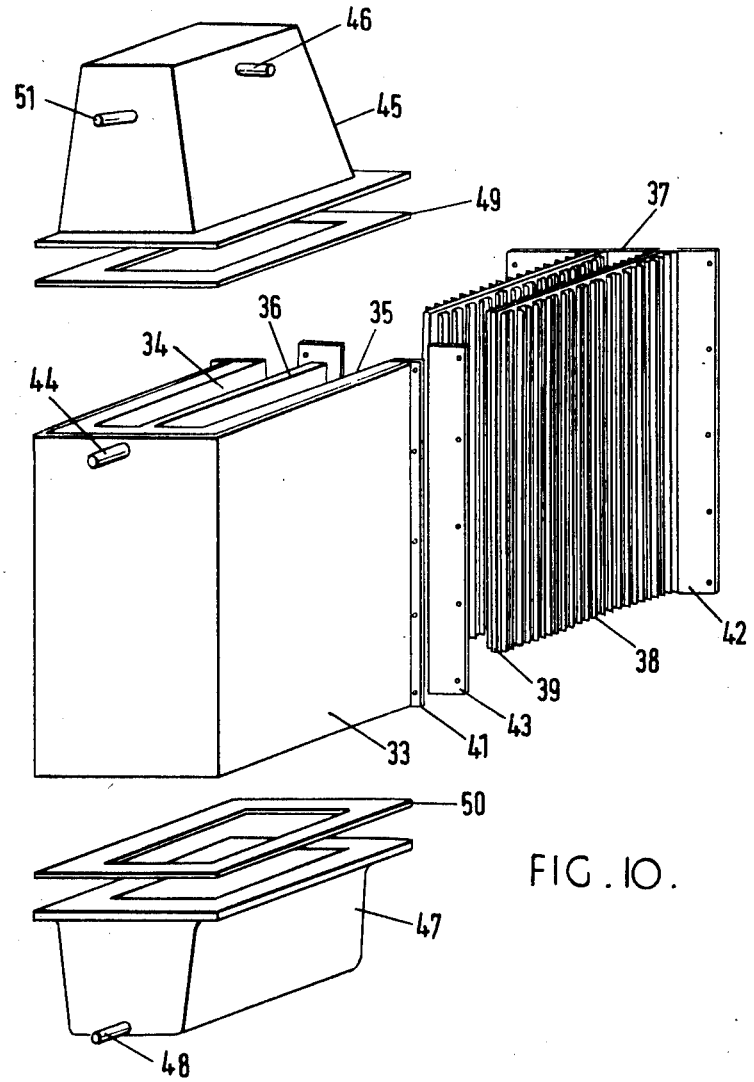
FIG. 10 is an exploded view of the constituent parts of a laboratory vertical diaphragm cell according to the invention for the electrolysis of sodium chloride brine and including a double-sided anode comprising a plurality of elongated members mounted on a backing plate and an asbestos diaphragm.

Referring to FIG. 10, the diaphragm cell includes a mild steel cathode box 33 having two half mild steel plate cathodes 34, 35 and a central mild steel plate cathode 36, and an anode box 37 comprising two anodes each consisting of two pairs of titanium double blades 38 mounted back to back to each other on to a common titanium backing plate 39. Asbestos diaphragms 40 (shown in FIG. 11) fit between the corresponding cathode plates and the anodes and are in close proximity to the double blades 38. The anode box 37 and the cathode box 33 are connected by means of flanges 41, 42, and rubber gaskets 43 are located between the said anode and cathode boxes. The cathode box 33 is provided with an outlet 44 for hydrogen. The top cover 45 is fitted with an exit pipe 46 for chlorine and an inlet pipe 51 for sodium chloride brine. The cell is further provided with a base member 47 having an outlet 48 for caustic soda. Intervening rubber gaskets 49, 50, are situated between the top cover 45 and the anode/cathode unit and between the base member 47 and the anode/cathode unit. The anode box 37 and the cathode box 33 are so designed that when assembled they provide a central anolyte recirculation passage and give an anode/cathode gap of 6 mm.

Figure 11:
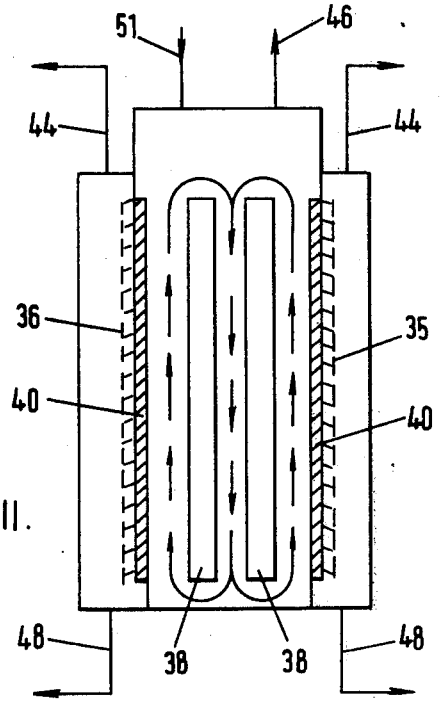
FIG. 11 is a schematic flow diagram of the diaphragm cell of FIG. 10 showing the anolyte recirculation system.

Referring to FIG. 11, which shows one pair only of the channel blade anodes 38, it will be seen that when the cell is operating the anolyte liquor flows as indicated by the arrows.

Figure 12:
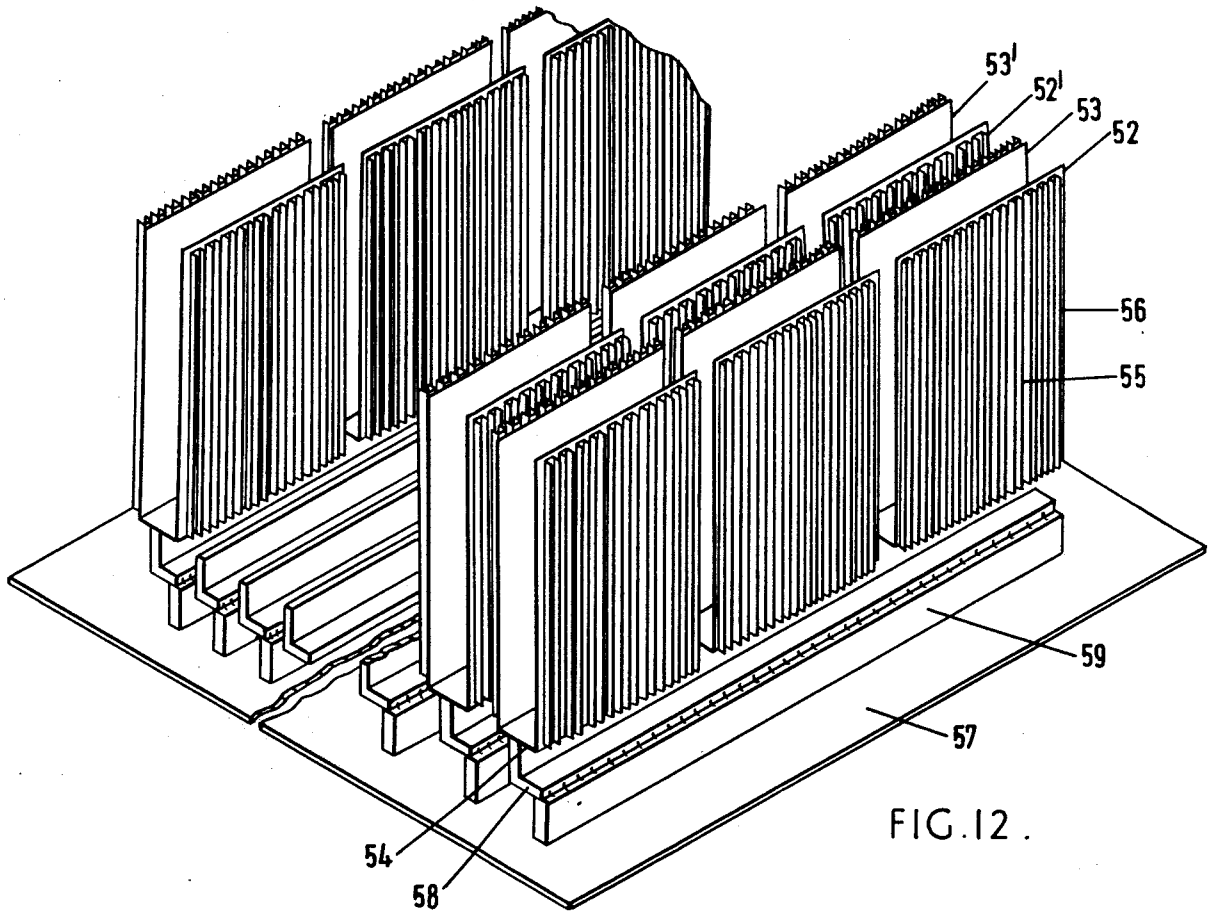
FIG. 12 is a perspective view of an anode assembly in a vertical diaphragm cell according to the invention in which each anode comprises a plurality of double-bladed elongated members mounted on a backing plate, and pairs of anodes are connected to bars mounted on the baseplate of the cell.

Referring to FIG. 12, the diaphragm cell includes an anode assembly consisting of a plurality of pairs of anodes 52, 53; 52', 53', each pair being connected at their base by means of a connecting plate 54. Each anode consists of a plurality of double blades 55 of titanium on a titanium backing plate 56, and the connecting plate 54 is also of titanium. Each pair of anodes is supported on and electrically connected to the titanium baseplate 57 of the cell by welding the connecting plate 54 to an L-shaped titanium bar 58, which is in turn welded to a titanium bar 59, the lower end of which is welded to the baseplate 57. The anodes are arranged as shown in FIG. 12 so that adjacent anodes, for example 53, 52', face another. Mild steel plate cathodes (not shown), provided with their associated diaphragms, are inserted between opposing pairs of anodes.

Figure 13:
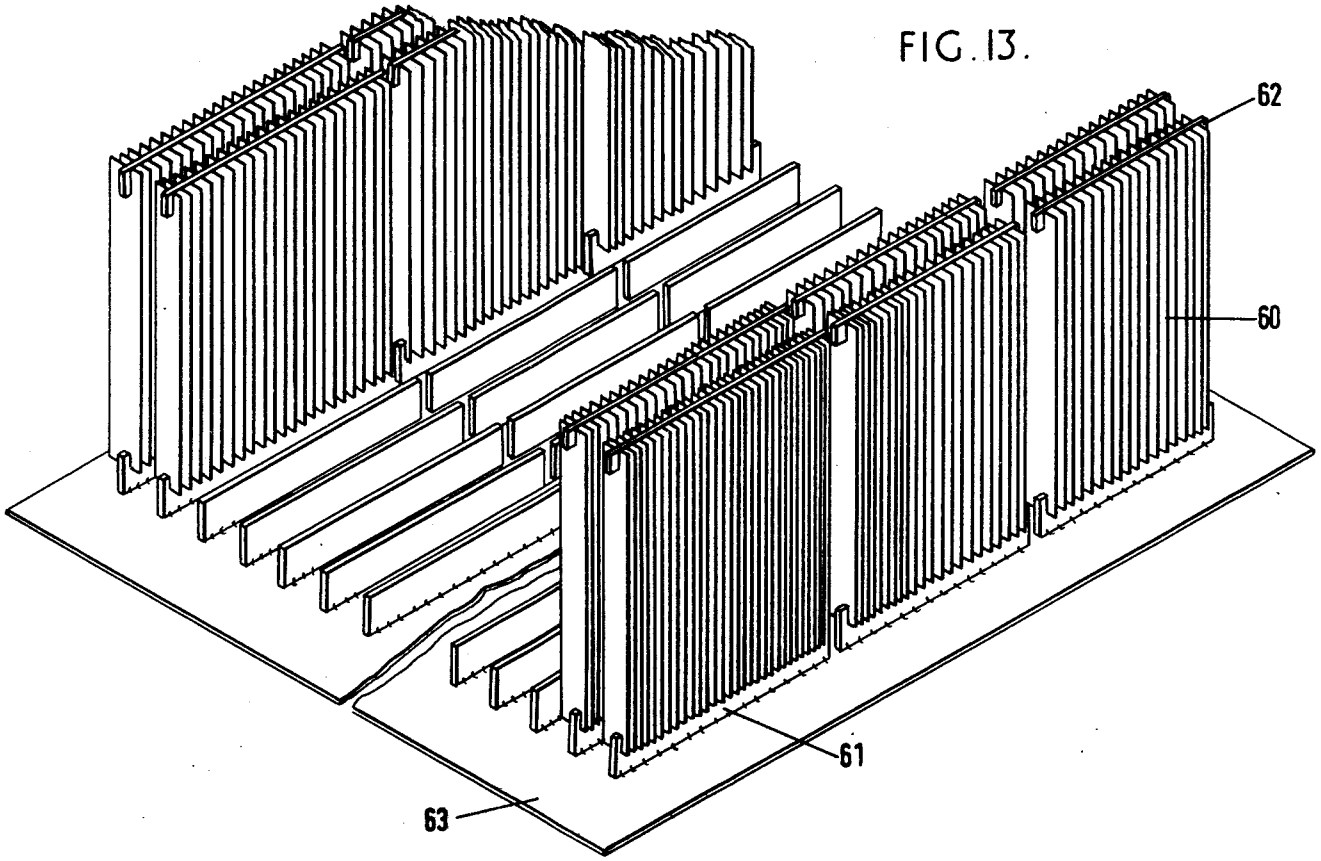
FIG. 13 is a perspective view of an anode assembly in a vertical diaphragm cell according to the invention in which each pair of anodes is formed by a plurality of single-bladed elongated members connected at their base to a lateral support bar which is in turn mounted on the baseplate of the cell.

Referring to FIG. 13, the diaphragm cell includes an anode assembly consisting of a plurality of parallel single blades 60 of titanium which are rigidly supported by means of titanium bars 61, 62. The bar 61 is welded to the titanium baseplate 63 of the cell. Mild steel plate cathodes (not shown), provided with their associated diaphragms, are inserted between opposing pairs of anodes.

The invention is further illustrated but not limited by the following Examples.

EXAMPLE 1

The anode (of the type shown in FIG. 1) comprised a titanium plate (18 gauge; 92 cm long and 7.6 cm wide) to which was spot-welded 8 double blades, each blade consisting of a pair of flat rectangular titanium strips (18 gauge; 90 cm long, 6 mm depth, 4 mm apart). The blades were coated with a mixture of ruthenium oxide/titanium dioxide.

The anode so produced was assembled into a vertical laboratory diaphragm cell of the type shown in FIG. 3 and as described above. The cell was provided with a mild steel woven gauze cathode and a polytetrafluoroethylene diaphragm. The anode/cathode gap was 1.5 to 2.0 mm.

The cell was filled with saturated sodium chloride brine and a current equivalent to a cathodic density of 2 kA/m$^2$ was passed through the cell. The cell operating voltage was found to be 2.68 volts. The electrolysis was carried out at different salt conversions (by modifying the flow of feed brine) and the current efficiencies obtained were as follows:

| Current Efficiency (%) | Salt Conversion (%) |
|---|---|
| 98.4 | 40 |
| 96.7 | 50 |
| 94.5 | 60 |
| 91.6 | 70 |
| 87.3 | 80 |

A pH of 3.1 to 3.2 (at 50% conversion) was maintained in the anolyte compartment and in addition, no loss of diaphragm permeability was evident after 24 days operation of the cell at 50% conversion.

By way of comparison, the cell was operated with a flat titanium sheet anode of the same overall dimensions as the anode used above and carrying the same ruthenium oxide/titanium dioxide coating. A normal anode/cathode gap of 7.0 mm was used.

At a current density of 2 kA/m$^2$, the cell operating voltage was much higher than when using the 'blade-type' anode, namely 3.10 volts instead of 2.68 volts. The fall-off in current efficiency with increase in salt conversion was also much greater as is shown below:

| Current Efficiency (%) | Salt Conversion (%) |
|---|---|
| 97.8 | 40 |
| 95.5 | 50 |
| 92.5 | 60 |
| 87.0 | 70 |
| 80.0 | 80 |

A pH of 3.90 to 4.50 (at 50% conversion) was maintained in the anolyte compartment and a gradual loss of diaphragm permeability was observed over a period of 10 days, after which it became necessary to clean the diaphragm, for example by washing with brine.

EXAMPLE 2

The anode was of the same dimensions as that used in Example 1 but in this instance the double blades were spot-welded to a rectangular shaped titanium frame instead of a titanium sheet (ie the anode was of the type shown in FIG. 5). This in effect eliminated the directed internal circulation indicated in FIG. 4. The anode was coated with the same ruthenium oxide/titanium oxide coating as described in Example 1.

An anode/cathode gap of 1.5 to 2.0 mm was used (as in Example 1) and at a current density of 2 kA/m$^2$, the cell operating voltage was 2.76 volts. The fall-off in current efficiency with increase in salt conversion was somewhat greater than when using the 'blade-type' sheet anode of Example 1, but not as great as the fall-off observed with a titanium sheet anode. The results were as follows:

| Current Efficiency (%) | Salt Conversion (%) |
|---|---|
| 98.0 | 40 |
| 96.0 | 50 |
| 93.5 | 60 |
| 90.5 | 70 |

A pH of 3.3 to 3.4 (at 50% conversion) was maintained in the anolyte compartment and a gradual loss of diaphragm permeability was observed over a period of 25 days, after which it became necessary to clean the diaphragm, for example by washing with brine.

EXAMPLE 3

The anode (of the type shown in FIG. 5) consisted of 58 titanium (18 gauge) blades made up of 29 double blades, each blade being 43 cm long and 7 mm deep, and the spacing between successive blades being 4 mm. The double blades were spot-welded to the titanium frame 28 and two titanium ribs 29. The blades were coated with a mixture of ruthenium oxide/titanium dioxide.

The anode so produced was assembled into a vertical laboratory diaphragm cell of the type shown in FIG. 6 and as described above. The cell was provided with a mild steel woven gauze cathode and a polytetrafluoroethylene diaphragm. The anode/cathode gap was 2.5 to 3.0 mm.

The results were as follows:

| Current Efficiency (%) | Salt Conversion (%) |
|---|---|
| 98.6 | 45 |
| 98.0 | 50 |
| 96.0 | 60 |
| 92.0 | 70 |

The cell was filled with saturated sodium chloride brine and a current equivalent to a cathode density of 2 kA/m$^2$ was passed through the cell. The cell operating voltage was found to be 2.7 volts.

When the cell was operated at 50% salt conversion, a pH of 3.4 was maintained in the anolyte compartment, and in addition, no loss of diaphragm permeability was evident after 24 days operation.

EXAMPLE 4

The anode consisted of 58 titanium (18 gauge) blades made up of 29 double blades, each blade being 43 cm long and 7 mm deep, and the spacing between successive blades being 4 mm. The double blades were spot-welded to the titanium frame 1 and two titanium ribs 2. The blades were coated with a mixture of ruthenium oxide/titanium dioxide.

The cathode consisted of 58 mild steel blades made up of 29 double blades, each blade being 43 cm long and 7 mm deep, and the spacing between successive blades being 4 mm. The double blades were spot-welded to the mild steel frame 1 and two mild steel ribs 2.

The anode and cathode so produced were assembled into a vertical laboratory diaphragm cell of the type shown in FIG. 6 and as described above. The cell was provided with a polytetrafluoroethylene diaphragm. The anode/cathode gap was 1.5 to 2.0 mm.

The cell was filled with saturated sodium chloride brine and a current equivalent to a cathode density of 2 kA/m$^2$ was passed through the cell. The cell operating voltage was found to be 2.65 to 2.7 volts.

When the cell was operated at 50% salt conversion, a pH of 3.2 to 3.4 was maintained in the anolyte compartment and in addition, no loss of diaphragm permeability was evident after 24 days operation.

EXAMPLE 5

An anode of dimensions 100 cm height and 32 cm width was obtained by spot-welding 30 double blades to a solid titanium plate. Two such anodes were joined back-to-back by means of vertical titanium U-shaped spacer pieces to obtain a box anode, so as to allow internal circulation down the interior of the box. The resultant anode structure was coated with the same ruthenium oxide/titanium oxide coating as described in Example 1.

Two such anode structures were assembled into a vertical diaphragm cell of the type shown in FIG. 10 containing two half-cathode fingers of dimensions 100 cm height and 32 cm width and a central cathode finger, the cathode assembly having previously been clad with a deposited chrysotile asbestos diaphragm of thickness 2 to 3 mm. The anode/cathode gap was 6 mm.

The cell was filled with saturated sodium chloride brine and a current equivalent to a cathodic density of 2.5 kA/m$^2$ was passed through the cell. The cell operating voltage (titanium to mild steel) was found to be 3.33 volts. The current efficiency results were as follows:

| Current Efficiency (%) | Salt Conversion (%) |
|---|---|
| 97.1 | 50.6 |
| 94.5 | 58.4 |

What we claim is:

1. An electrolytic cell comprising an anode, a cathode and a diaphragm separating the anode and the cathode wherein the anode presents to the cathode a plurality of spaced-apart parallel elongated members disposed in vertical planes so as to form a plurality of vertical channels, said members being constructed of a film-forming metal and carrying on at least part of their surfaces an electrocatalytically active coating and wherein said elongated members are rigidly mounted in the cell so that a substantial portion of said active surfaces is 6 millimeters or less from the cathode.

2. An electrolytic cell as claimed in claim 1 wherein said elongated members are mounted on support means forming part of the anode.

3. An electrolytic cell as claimed in claim 2 wherein the elongated members present their narrower edge to the cathode.

4. An electrolytic cell as claimed in claim 2 wherein said elongated members are in the form of blades, rods or channel shaped members mounted on said support means.

5. An electrolytic cell as claimed in claim 2 wherein said elongated members are in the form of double blades which are spaced apart from and connected to one another by one or more bridge portions suitable for strengthening purposes and/or for connecting to said support means.

6. An electrolytic cell as claimed in claim 1 wherein the distance between adjacent elongated members is in the range of 1.5 to 10 mm.

7. An electrolytic cell as claimed in claim 6 wherein the distance between adjacent elongated members is in the range from 2 to 5 mm.

8. An electrolytic cell as claimed in claim 2 wherein said support means comprises a backing plate.

9. An electrolytic cell as claimed in claim 8 wherein said support means is a substantially solid metal sheet provided with apertures for recycling of anolyte.

10. An electrolytic cell as claimed in claim 2 wherein said support means comprises a backing frame.

11. An electrolytic cell as claimed in claim 10 wherein said backing frame is provided with one or more lateral support ribs for connection to said elongated members.

12. An electrolytic cell as claimed in claim 2 wherein said support means comprises a lateral support bar connected to one end of the elongated members and suitable for connecting the said members to the baseplate of the cell.

13. An electrolytic cell as claimed in claim 2 wherein said support means comprises a multi-apertured backing sheet.

14. An electrolytic cell as claimed in claim 13 wherein said foraminous metal backing sheet comprises woven gauze, drilled plate or expanded metal.

15. An electrolytic cell as claimed in claim 1 wherein said elongated members are made of a film-forming metal as hereinbefore defined.

16. An electrolytic cell as claimed in claim 1 wherein said support means is made of a film-forming metal as hereinbefore defined.

17. An electrolytic cell as claimed in claim 15 wherein the film-forming metal is titanium or an alloy of titanium.

18. An electrolytic cell as claimed in claim 1 wherein the electrocatalytically active coating comprises a platinum group metal oxide and an oxide of a film-forming metal.

19. An electrolytic cell as claimed in claim 17 wherein the coating comprises ruthenium oxide and titanium oxide.

20. An electrolytic cell as claimed in claim 1 wherein the cathode comprises a perforated metal plate or tube.

21. An electrolytic cell as claimed in claim 1 wherein the cathode comprises a plurality of parallel elongated members mounted on support means.

22. An electrolytic cell as claimed in claim 21 wherein the cathode comprises a plurality of blades, rods or channel shaped members mounted on support means.

23. An electrolytic cell as claimed in claim 22 wherein the cathode comprises a plurality of parallel elongated members in the form of double blades which are spaced apart from and connected to one another by one or more bridge portions suitable for strengthening purposes and/or for connecting to said support means.

24. An electrolytic cell as claimed in claim 1 wherein the cathode is of mild steel.

25. An electrolytic cell as claimed in claim 1 wherein the diaphragm comprises polytetrafluoroethylene.

26. An electrolytic cell as claimed in claim 1 wherein the diaphragm comprises asbestos.

27. An electrolytic cell as claimed in claim 1 wherein the anode/cathode gap is 1.5 to 3 mm.

28. An electrolytic cell as claimed in claim 1 wherein the elongated members of the anode are mounted substantially vertically in the cell.

29. A method of manufacturing chlorine by electrolysing an aqueous alkali metal chloride solution in an electrolytic cell as claimed in claim 1.

30. A method as claimed in claim 29 wherein the alkali metal chloride is sodium chloride.

* * * * *